United States Patent [19]

Lundberg

[11] Patent Number: 4,642,828

[45] Date of Patent: Feb. 17, 1987

[54] METHOD FOR PREVENTING CONTACT WITH CONTAMINATED TEXTILES AND/OR SPREADING OF CONTAMINANTS THEREIN

[76] Inventor: Knut B. L. Lundberg, Stenöregatan 19, S-230 44 Vintrie, Sweden

[21] Appl. No.: 747,167

[22] Filed: Jun. 20, 1985

[30] Foreign Application Priority Data

Jun. 26, 1984 [SE] Sweden ..... 8403385

[51] Int. Cl.[4] ..... D06B 5/24

[52] U.S. Cl. ..... 8/149.3; 8/158; 68/5 C

[58] Field of Search ..... 8/149.1, 149.3, 150, 8/158; 68/5 C, 6, 210; 252/626

[56] References Cited

U.S. PATENT DOCUMENTS

| | | | |
|---|---|---|---|
| 2,645,914 | 7/1953 | Sessions | 68/10 |
| 3,126,555 | 3/1964 | Curtin | 8/149.1 |
| 3,762,868 | 10/1973 | Champel et al. | 8/149.2 |

FOREIGN PATENT DOCUMENTS

| | | | |
|---|---|---|---|
| 487111 | 12/1929 | Fed. Rep. of Germany . | |
| 2511064 | 6/1976 | Fed. Rep. of Germany . | |
| 3116961 | 11/1982 | Fed. Rep. of Germany | 68/5 C |

*Primary Examiner*—Philip R. Coe

*Attorney, Agent, or Firm*—Tarolli, Sundheim & Covell

[57] ABSTRACT

The present invention relates to a method for preventing contact with contaminated textiles and/or spreading of contaminants therein during transport and cleaning of the textiles (5). In order to ensure that personnel neither can come in contact with the contaminated textiles (5) nor is exposed to liquid or gaseous contaminants emanating from the textiles, the method is characterised by the fact that the textiles (5) are collected in a hermetically sealable, transportable and to a cleaning device (6) connectable transport container (1), which in hermetically sealed condition is transported to the cleaning device and connected thereto for admission of medium for driving out contaminants from the textiles (5) before the container is opened for removing the textiles. This method is performed perferably by means of a simple container which is characterised by consisting of a transport container (1) having a sealing means (2) for hermetically sealing the transport container during storage transport and cleaning of textiles (5) therein and having at least one connecting device (3 and/or 4) for connection of a device (8) forming part of the cleaning device (6) and generating medium for driving out contaminants from the textiles (5).

8 Claims, 3 Drawing Figures

METHOD FOR PREVENTING CONTACT WITH CONTAMINATED TEXTILES AND/OR SPREADING OF CONTAMINANTS THEREIN

The present invention relates to a method for preventing contact with contaminated textiles and/or spreading of contaminants therein during transport and cleaning of said textiles.

Contaminated textiles in the form of cleaning cloths for printing machines contain several detrimental matters or substances. These cleaning cloths have been stored, transported and cleaned in vessels open to such extent that the contaminants have spread to the surroundings in gaseous or liquid shape. Furthermore, it has not always been possible to avoid contact with the contaminated cloths during transport and cleaning. Thus, there is a risk for severe occupational injuries among the transport and/or laundry personnel while they have been forced to work under insufficient environmental conditions.

The object of the present invention is to eliminate these problems and provide a method which by simple means completely eliminates the risk for coming in contact with the contaminated textiles during transport and cleaning thereof and for the contaminants to spread by flowing off or evaporation. This is accomplished by collecting the textiles in a hermetically sealable container which in a hermetically sealed condition is transported to a cleaning device and is connected thereto for admission of medium for driving out contaminants from the textiles before the container is opened for removing the textiles.

Another object of the present invention is to provide a simple and efficient container for carrying out the method of the invention, which container comprises a sealing means for hermetically sealing it during storage, transport, and cleaning of the textiles and further comprises at least on connecting device for connecting to a cleaning device.

The method according to the invention prevents personnel from coming in contact with the contaminated textiles during transport or cleaning thereof and the personnel is neither exposed to such contaminants that eventually flow off the textiles during transport or cleaning or evaporate therefrom as gases dangerous to the environment. First when the textiles are cleaned from all contaminants dangerous to the personnel, the container is opened and the textiles removed for eventual further cleaning.

The container according to the invention may be used in hermetically sealed condition as a part of the cleaning device during one or more cleaning processes.

The invention will be further described below with reference to the accompanying drawings, in which FIG. 1 schematically illustrates the method according to the invention;

Figure 1:
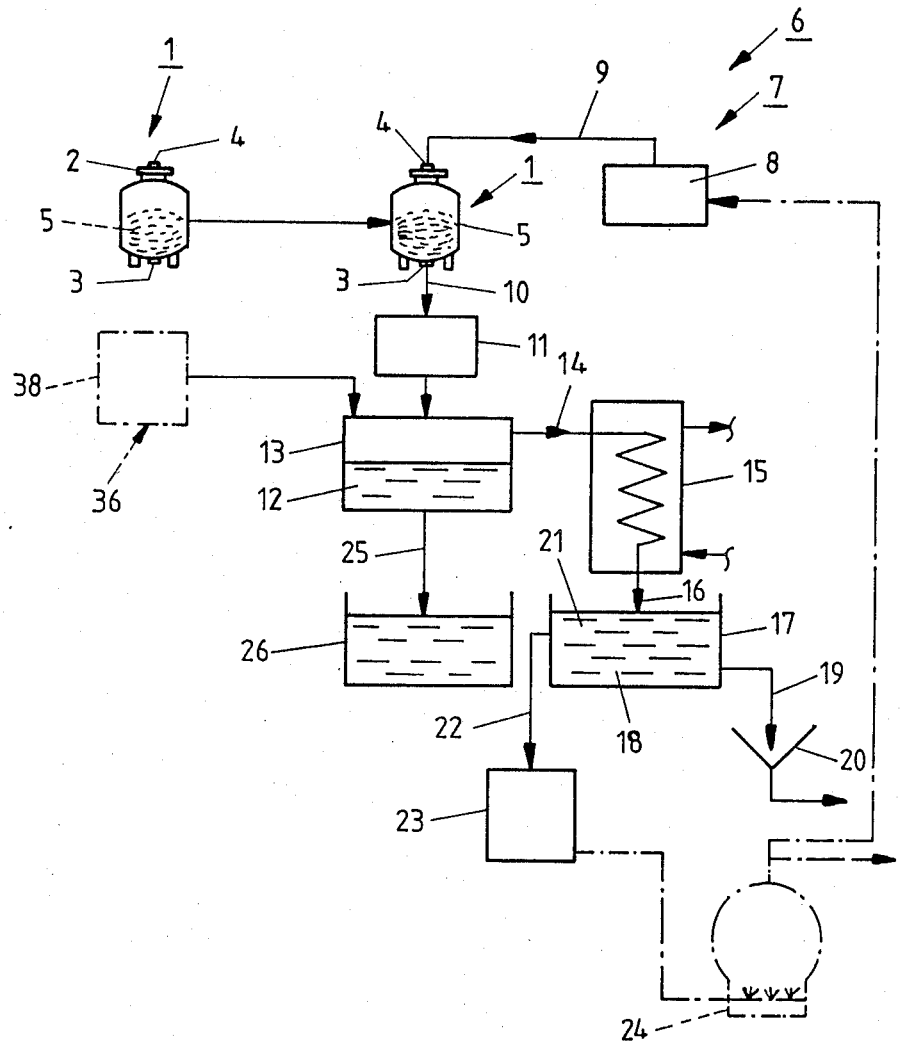

In the drawings, a transport container 1 for set up in a printery is shown. The container 1 is a so called pressure vessel which withstands inner overpressures without being damped and it has a sealing means 2, preferably in the form of a braceable cover for hermetically sealing the container 1 during storage, transport and cleaning of contaminated cleaning cloths 5 collected therein or other textiles or similar objects. When a sufficient number of cleaning cloths 5 has been collected in the container 1, said container is hermetically sealed by closing and bracing the cover 2, whereafter the container in its hermetically sealed condition is placed on a vehicle by a fork truck or crane for transportation to a cleaning device 6. In hermetically sealed condition, the transport container 1 prevents personnel from coming in direct contact with the contaminated cleaning cloths 5 and from being exposed to contaminants flowing off or evaporating from said cloths.

The transport container 1 also has one or more adapters 3 and 4 for connecting the container 1 to the cleaning device 6 without opening said container. When the transport container 1 is placed at a suitable location in the cleaning device 6, a steam generating device 8 in a part 7 of the cleaning device 6 is connected to the adapter 4 via a conduit 9 for feeding steam into the container 1. The container has an automatic or manually controlled inlet valve (not shown) which may be opened for admitting steam after connection of the conduit 9. While steam is fed into the transport container 1 at the top thereof, e.g. during 10–30 minutes, the pressure is increased (also the temperature is somewhat increasing) in the container and this pressure increase results in that a portion of the liquid solvents and the heavy metals present in the cleaning cloths 5 and the transport container 1 is pressed out through the lower outlet 3 of the container by automatically or manually open an outlet valve (not shown) and fed through a conduit 10 to a tank 11. The discharged solvent 12, is fed to a heating device 13 and heated therein until combustible matters in the solvent 12, e.g. petroleum products, are transformed into gases. These combustible matters are as gases transferred through a conduit 14 to a cooling device 15, wherein said matters are transformed into liquids which are fed through a conduit 16 to a water separator 17. Separated water 18 is fed through a conduit 19 to a drain 20, while the combustible matters 21 are fed via a conduit 22 to a tank 23. The product collected in the tank 23 may be used as fuel for various purposes, e.g. for supporting a burner 24 in a boiler in the steam generating device 8 and/or for supporting a heating device in connection with the illustrated cleaning device 6 and/or another cleaning device. This rest product obtained in the heating device 13 is fed through a conduit 25 to a container 26 and is therein brought to a destruction plant.

Figure 2:
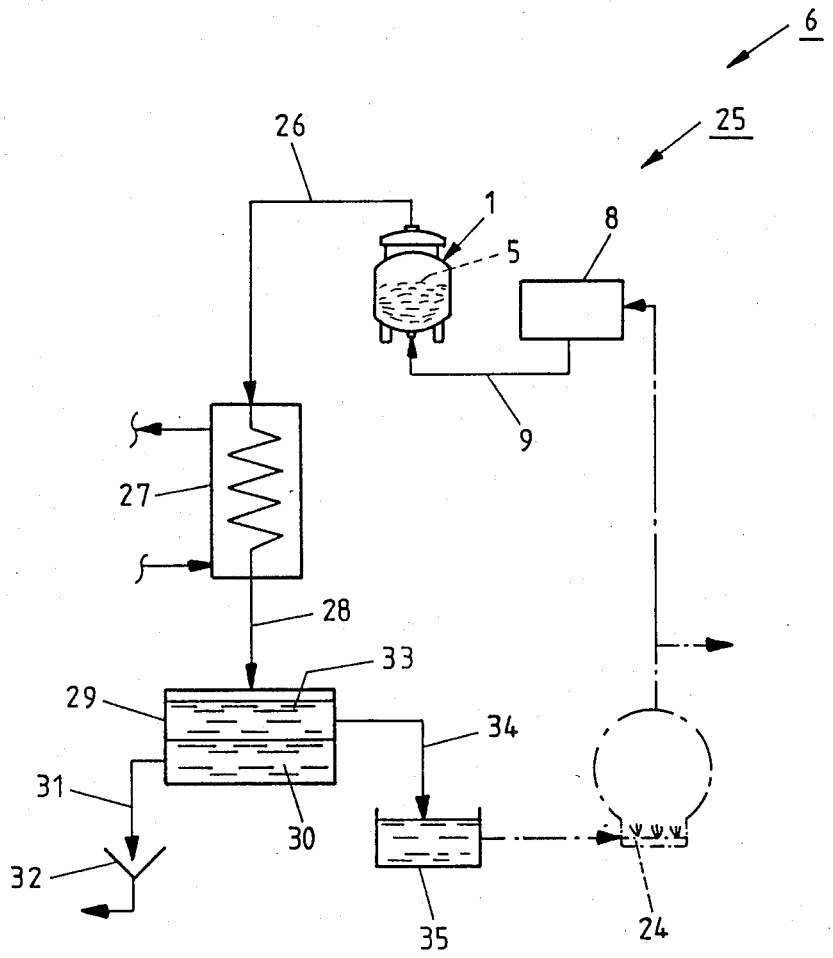
FIG. 2 illustrates another process in said method.

Thereafter, the cleaning cloths 5 are subjected to a second cleaning process (a so called distillation process) in a part 25 (see FIG. 2) of the cleaning device 6 and this process is carried out while said cloths 5 are still hermetically enclosed in the transport container 1. During this second cleaning process, use is made of the steam generating device 8 but the conduit 9 thereof is instead connected to an adapter 3 forming part of the outlet of the transport container 1 which is now instead used as inlet for feeding steam into said container at the bottom thereof. The steam is fed after the outlet valve in question has opened or has been opened, e.g. at a temperaure of about 110° C. and during 1–2 hours, whereby solvents present in the cleaning cloths 5 are transformed into gases. These gases are fed to a cooling device 27 via a conduit 26 connected to said upper pipe 4 and in said cooling device 27, the gases are transformed into liquids which are fed through a conduit 28 to a water separator 29. Water 30 separated therein is fed through a conduit 31 to a drain 32, while combustible matters 33 via a conduit 34 are fed to a tank 35. The product collected therein may be used as fuel for various purposes, e.g. for supporting a burner 24.

After this second cleaning process, the cleaning cloths 5 have been transported and cleaned from the major part of dangerous matters collected therein while enclosed in the transport container 1, which means that no personnel for transport or cleaning have come in contact with these dangerous matters. Furthermore, the one and same device 8 has been used in both cleaning processes and portions of the dangerous matters have been reused as fuel.

Figure 3:
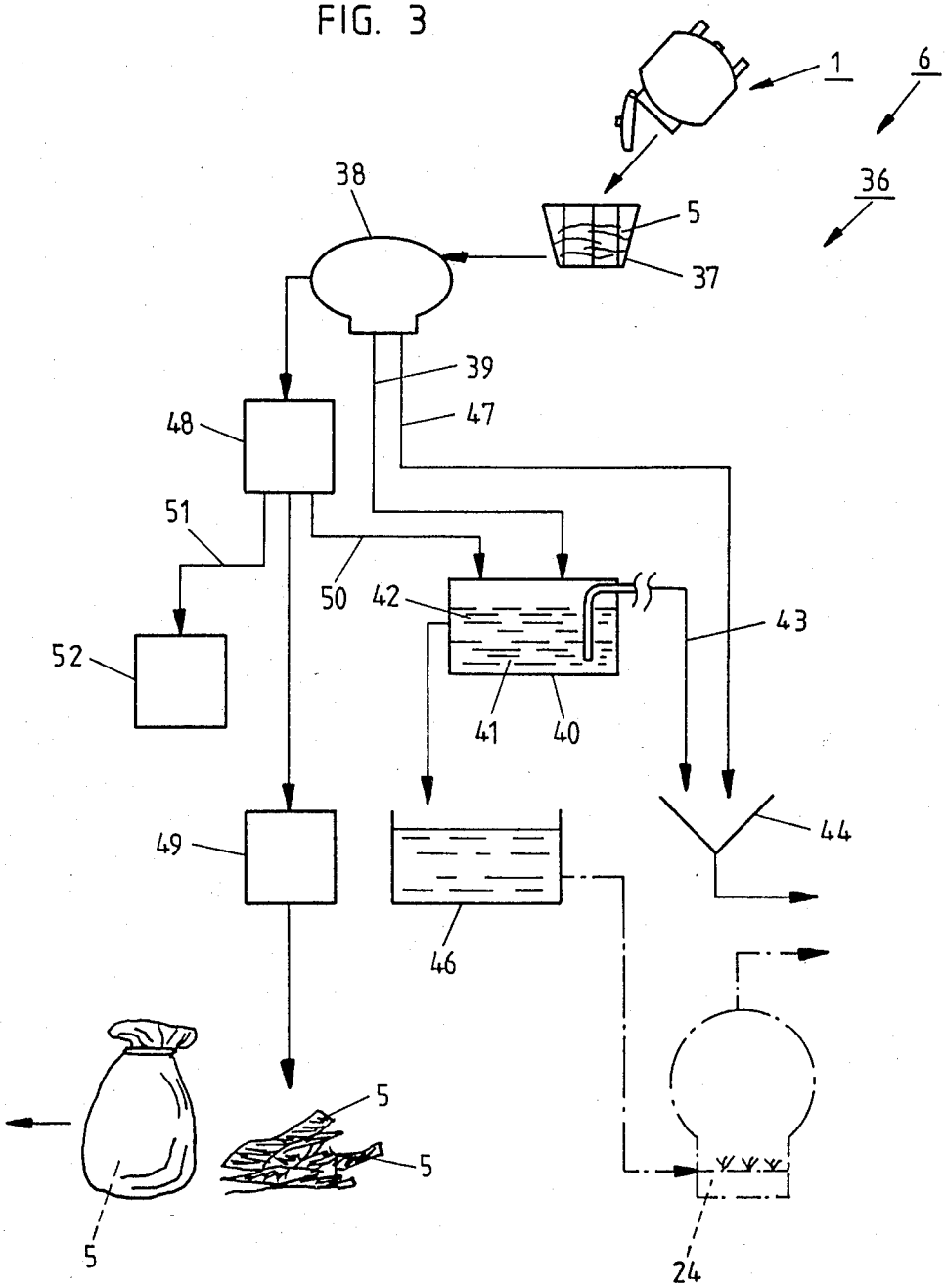
FIG. 3 illustrates a third process or step in said method.

When the second cleaning process is finished and the transport container 1 is emptied of dangerous gases via the conduit 26, the conduits 9, 26 are disconnected, the transport container 1 is opened (see FIG. 3) and the cleaning cloths 5, which are now sufficiently clean to enable handling thereof, are brought out of the container 1 and transferred to a washing device 36 via a suitable basket 37 or similar.

Since the transport container 1 is empty, it is transported to a graphic industry for a refill of contaminated cleaning cloths 5.

The washing device 36 forms part of the cleaning device 6 and comprises a washing machine 38 in which the cleaning cloths 5 are washed in water provided with washing material. In the washing machine 38, the cleaning cloths 5 are washed after a certain program and contaminated water is fed from the machine 38 through a conduit 39 to a water separator 40, in which water 41 and combustible matters such as oil 42 are separated from each other, whereby the water 41 is fed through a conduit 43 to a drain 44 while the oil 42 via a conduit 45 is fed to a tank 46. This oil may be used as fuel for different purposes, e.g. in the burner 24. Pure washing water is fed through a conduit 47 from the washing machine 38 directly to the drain 44.

After washing the cleaning cloths 5, said cloths are brought from the washing machine 38 to a centrifuge 48 and then to a tumbler dryer 49, whereafter they are packed and returned to graphic industries in completely clean and dry condition for reuse. Water mixed with oil from the centrifuge 48 is fed via a conduit 50 to the oil separator 40 and water mixed with fibres is fed via a conduit 51 to a fiber separator 52 for separating the fibres.

The invention is not limited to the above process and the device illustrated in the drawings, but may vary within the scope of the following claims, Thus, other contaminated textiles than cleaning cloths for the graphic industry or similar may be stored, transported and cleaned by means of the method according to the invention and the textiles or similar to be transported and cleaned may be reused in cleaned condition (as is normally the case for e.g. the cleaning cloths) or subjected to destruction in cleaned condition (as for e.g. cleaning rags or cleaning paper, which is burnt in cleaned condition).

In the cleaning process, the textiles or similar may be cleaned from other contaminants than the above and the cleaning method may comprise one or several steps, whereby said textiles or similar are enclosed in the transport container during one or more or all of these steps. Important is primarily that the textiles or similar are transported and treated hermetically enclosed in the transport container 1 until they are free of detrimental amounts of dangerous contaminants and that said container is not opened before it is emptied for detrimental amounts of dangerous contaminants.

The cleaning device may also vary in its structure and function. Thus, another pressure medium than steam may be used in the first process and instead of a pressure medium, a device for generating a vacuum in the transport container 1 may be used. Preferably, the transport container 1 is a pressure container which is designed to be handled with fork trucks and its upper and lower pipes may be sealed but admissible when required.

The transport container 1 may also vary in its construction while maintaining the possibility or hermetically sealing said container. Thus, the transport container 1 may have a connecting device 3 and 4 respectively, at the top or at the bottom or at the top and at the bottom. Each connecting device 3 and/or 4 may be combined with an inlet and/or outlet such that medium may be admitted at the top and discharged at the bottom or admitted at the bottom and discharged at the top. The transport container 1 may eventually be provided with a connecting device and a combined inlet and outlet associated therewith through which medium may be fed into the transport container and contaminants discharged therefrom. The openings for admission of medium and discharge of contaminants during the cleaning processes are normally closed by valves of conventional type, which are operable to open automatically when connecting the conduit 9 to the connecting devices or open automatically or manually in any other way. The valves are designed to close automatically or be closed manually when the conduit 9 is disconnected. The connecting devices have suitable adapters of conventional type to which corresponding adapters on the conduit 9 may be connected, such that a tight connection is obtained.

I claim:

1. Method for preventing contact with contaminated textiles and/or spreading of contaminants therein during transport and cleaning of said textiles (5), characterised by collecting the textiles (5) in a hermetically sealable, transportable and to a cleaning device (6) connectable transport container (1), which in hermetically sealed condition is transported to the cleaning device and connected thereto for admission of medium for driving out contaminants for the textiles (5) before the container is opened for removing said textiles.

2. Method according to claim 1, characterised by connecting the transport container (1) in hermetically sealed condition to a pressure medium-generating device (8) forming part of the cleaning device (6) for pressing out contaminants from the textiles (5) by means of pressure medium.

3. Method according to claim 2, characterised by connecting the transport container (1) in hermetically sealed condition to a pressure medium-generating device in the form of a steam generating device (8) forming part of the cleaning device (6) and feeding steam from the steam generating device into the transport container (1) for heating the textiles (5) therein.

4. Method according to claim 2 or 3, characterised by feeding pressure medium into the transport container (1) at the top thereof while discharging contaminants in the form of liquids from said container (1) at the bottom thereof and collecting said contaminants as fuel after heating for separation of combustible products and removal of water.

5. Method according to claim 1, 2 or 3, characterised by altering the connection of the transport container (1) to the cleaning device (6) after performing a first cleaning process for subjecting the textiles (5) to a second cleaning process before opening the hermetically sealed container (1).

6. Method according to claim 5, characterised by connecting the transport container (1), for performing the second cleaning process, to a device (8) for generating heating medium and feeding heating medium into the transport container (1) for transforming contaminants in the textiles (5) into gases.

7. Method according to claim 6, characterised by feeding medium for performing the first cleaning process into the transport container (1) at the top thereof while discharging liquid contaminants from the container at the bottom thereof and feeding medium for performing the second cleaning process into the transport container (1) at the bottom thereof while discharging gaseous contaminants from said container at the top thereof.

8. Method according to claim 7, characterised by collecting gaseous contaminants discharged from the transport container (1) at the top thereof as fuel after transformation of said contaminants into liquids and removal of water.

* * * * *